US008556472B2

(12) United States Patent
Magarill

(10) Patent No.: US 8,556,472 B2
(45) Date of Patent: Oct. 15, 2013

(54) LIGHT REFLECTORS AND FLOOD LIGHTING SYSTEMS

(76) Inventor: Simon Magarill, Cincinnati, OH (US)

( * ) Notice: Subject to any disclaimer, the term of this patent is extended or adjusted under 35 U.S.C. 154(b) by 179 days.

(21) Appl. No.: 13/247,373

(22) Filed: Sep. 28, 2011

(65) Prior Publication Data

US 2012/0075855 A1 Mar. 29, 2012

Related U.S. Application Data

(60) Provisional application No. 61/387,259, filed on Sep. 28, 2010.

(51) Int. Cl.
*F21V 7/00* (2006.01)

(52) U.S. Cl.
USPC . 362/346; 362/235; 362/296.01; 362/296.03; 362/297

(58) Field of Classification Search
USPC ..... 362/235, 346–348, 296.01, 362/296.03–296.05, 297
See application file for complete search history.

(56) References Cited

U.S. PATENT DOCUMENTS

| | | | | |
|---|---|---|---|---|
| 4,421,200 | A * | 12/1983 | Ferralli et al. | 181/144 |
| 4,953,063 | A * | 8/1990 | Nino | 362/539 |
| 5,552,922 | A | 9/1996 | Magarill | |
| 5,594,831 | A * | 1/1997 | Oparin et al. | 392/421 |
| 5,604,624 | A | 2/1997 | Magarill | |
| 5,625,738 | A | 4/1997 | Magarill | |
| 6,332,688 | B1 | 12/2001 | Magarill | |
| 6,461,000 | B1 | 10/2002 | Magarill | |
| 6,490,087 | B1 | 12/2002 | Fulkerson et al. | |
| 6,643,077 | B2 | 11/2003 | Magarill et al. | |
| 6,709,124 | B2 | 3/2004 | Magarill et al. | |
| 6,719,426 | B2 | 4/2004 | Magarill et al. | |
| 6,764,181 | B2 | 7/2004 | Magarill et al. | |
| 6,877,865 | B2 | 4/2005 | English, Jr. et al. | |
| 6,970,289 | B1 | 11/2005 | Auerbach et al. | |
| 6,972,810 | B2 | 12/2005 | Magarill et al. | |
| 6,976,759 | B2 | 12/2005 | Magarill et al. | |
| 7,008,065 | B2 | 3/2006 | English, Jr. et al. | |
| 7,070,301 | B2 | 7/2006 | Magarill | |
| 7,085,063 | B2 | 8/2006 | Magarill et al. | |
| 7,090,357 | B2 | 8/2006 | Magarill et al. | |

(Continued)

OTHER PUBLICATIONS

Simon Magarill, "Anamorphic Illuminator", Proc. SPIE 7785 (Aug. 18, 2010).

(Continued)

*Primary Examiner* — Ali Alavi
(74) *Attorney, Agent, or Firm* — Wood, Herron & Evans LLP

(57) ABSTRACT

Light reflectors and flood lighting systems for illumination and lighting. Each light reflector may include a housing having a plurality of facets, each of the plurality of facets having a shape that is a portion of separate ellipses sharing a common focus. First and second surfaces are defined by first and second planes intersecting along a line within a volume of the body. A light source is positioned near the first surface, at the common focus, and is angularly oriented thereto such that light emitted by the light source is directed into the housing, reflected by at least one of the plurality of facets, and exits the light reflector out of either the first plane or the second plane. The body of the light reflector may include a free-form surface that is generated as the best fit to the plurality of facets.

23 Claims, 13 Drawing Sheets

(56) References Cited

U.S. PATENT DOCUMENTS

| | | | | |
|---|---|---|---|---|
| 7,101,050 | B2 | 9/2006 | Magarill et al. | |
| 7,142,302 | B2 | 11/2006 | Magarill et al. | |
| 7,178,949 | B2 * | 2/2007 | Bernard et al. | 362/300 |
| 7,222,968 | B2 | 5/2007 | Magarill et al. | |
| 7,226,185 | B2 | 6/2007 | Dolgin et al. | |
| 7,261,423 | B2 | 8/2007 | Magarill et al. | |
| 7,390,097 | B2 | 6/2008 | Magarill | |
| 7,410,261 | B2 | 8/2008 | Magarill | |
| 7,411,734 | B2 | 8/2008 | Magarill et al. | |
| 7,411,735 | B2 | 8/2008 | Magarill et al. | |
| 7,422,330 | B2 | 9/2008 | Magarill | |
| 7,455,438 | B2 * | 11/2008 | Repetto et al. | 362/516 |
| 7,460,306 | B2 | 12/2008 | Magarill et al. | |
| 7,724,436 | B2 | 5/2010 | Magarill | |
| 7,821,713 | B2 | 10/2010 | Magarill et al. | |
| 2002/0154420 | A1 | 10/2002 | Magarill et al. | |
| 2003/0001990 | A1 | 1/2003 | Magarill et al. | |
| 2003/0007105 | A1 | 1/2003 | Magarill et al. | |
| 2003/0058408 | A1 | 3/2003 | Magarill et al. | |
| 2003/0142276 | A1 | 7/2003 | English et al. | |
| 2003/0210379 | A1 | 11/2003 | Magarill et al. | |
| 2004/0125376 | A1 | 7/2004 | Magarill et al. | |
| 2004/0233393 | A1 | 11/2004 | Magarill et al. | |
| 2005/0094401 | A1 | 5/2005 | Magarill | |
| 2005/0134811 | A1 | 6/2005 | Magarill et al. | |
| 2005/0140932 | A1 | 6/2005 | Magarill et al. | |
| 2005/0151939 | A1 | 7/2005 | English et al. | |
| 2005/0243330 | A1 | 11/2005 | Magarill et al. | |
| 2005/0244078 | A1 | 11/2005 | Magarill et al. | |
| 2005/0254018 | A1 | 11/2005 | Magarill et al. | |
| 2005/0254019 | A1 | 11/2005 | Magarill et al. | |
| 2005/0254131 | A1 | 11/2005 | Magarill et al. | |
| 2006/0039140 | A1 | 2/2006 | Magarill | |
| 2006/0072313 | A1 | 4/2006 | Magarill | |
| 2006/0139918 | A1 | 6/2006 | Dolgin et al. | |
| 2006/0221305 | A1 | 10/2006 | Magarill | |
| 2006/0262282 | A1 | 11/2006 | Magarill | |
| 2006/0274277 | A1 | 12/2006 | Magarill et al. | |
| 2006/0291770 | A1 | 12/2006 | Magarill et al. | |
| 2007/0103788 | A1 | 5/2007 | Magarill et al. | |
| 2007/0127245 | A1 | 6/2007 | Magarill et al. | |
| 2007/0279595 | A1 | 12/2007 | Magarill | |
| 2008/0068715 | A1 | 3/2008 | Magarill | |
| 2008/0285129 | A1 | 11/2008 | Magarill et al. | |
| 2009/0168028 | A1 | 7/2009 | Magarill | |
| 2010/0277796 | A1 | 11/2010 | Magarill et al. | |
| 2011/0007392 | A1 | 1/2011 | English, Jr. et al. | |
| 2011/0141442 | A1 | 6/2011 | Auerbach et al. | |

OTHER PUBLICATIONS

Olkier, "A rigorous method for synthesis of offset shaped reflector antennas", Computing Letters, vol. 2, No. 1-2 (2006) 29-49.

Fournier, et al., "Designing freeform reflectors for extended sources", Nonimaging Optics: efficient Design for Illumination and Solar Concentration VI, SPIE 2009.

* cited by examiner $$a^2 = b^2 + c^2$$

LIGHT REFLECTORS AND FLOOD LIGHTING SYSTEMS

CROSS-REFERENCE TO RELATED APPLICATIONS

This application claims the benefit of U.S. Provisional Application No. 61/387,259, filed Sep.28, 2010, which is hereby incorporated by reference herein in its entirety for all purposes.

BACKGROUND

The present invention relates generally to illumination and lighting and, more specifically, to light reflectors and flood lighting systems.

Faceted reflectors are known to those of ordinary skill in the art for producing a highly uniform patch of light and are commonly used in the production of surgical lights, car head lamps, and other applications where an intense beam of light, directed to a singular patch of area, is necessary for accomplishing a particular goal. For example, faceted reflectors used as surgical lights illuminate the specific area of surgical importance for the surgeon; faceted reflectors illuminate the road surface for an automobile driver without directing light into the line of sight of the in-coming traffic.

Rigorous mathematical algorithms and computational modeling have been used to increase the uniformity of the singular patch and to improve the sharpness of the border between the singular patch of light and the background. Additionally, reflector designs have been conventionally used for side, flood illumination of parking facilities, such as parking lot or garages. These reflector designs generally include a geometric housing, i.e., parabolic, elliptical, etc. These conventional designs have proven to be highly useful and efficient both energetically and economically. However, the illumination distribution created by these geometric housings is quite limited. As a result, several geometric housings must be incorporated and properly aligned for illuminating a given area to achieve required illumination distribution. Again, there is room for improvement in the field of side, flood illumination reflector design, as well as more generally in the field of light reflectors and flood lighting systems.

SUMMARY

In one embodiment, a light reflector includes a housing having a body with a plurality of facets. Each facet has a shape that is a portion of one of a plurality of ellipses sharing a common focus. The first and second surfaces are formed by first and second planes intersecting along a line within a volume of the body. The housing is arranged relative to the light source so that the light source is positioned near the first surface and at the common focus. The housing is angularly oriented relative to the light source such that a majority of light emitted by the light source is directed into the housing, reflected by at least one of the facets, and exits the light reflector out of either the first surface or the second surface.

In another embodiment, a flood lighting system is provided for illuminating a surface. The flood lighting system includes a plurality of light sources and a plurality of light reflectors. Each light reflector includes a housing having a body having a plurality of facets. Each facet has a shape that is a portion of one of a plurality of ellipses sharing a common focus. First and second surfaces are formed by first and second planes intersecting along a line within a volume of the body. One of the light sources is positioned near the first surface, at the common focus, and is angularly oriented relative to the respective housing such that a majority of light emitted by the light source is directed into the housing, reflected by at least one of the facets, and exits the light reflector out of one of the first or second surfaces. The flood lighting system is mounted at a distance from the surface.

In another embodiment, the body of the light reflector may include a free-form surface that is generated as the best fit to the plurality of facets. A free-form surface is used in CAD and other computer graphics software to describe the skin of a three-dimensional geometric element. A free-form surface lacks rigid radial dimensions in contrast to regular surfaces. One approach for generated a free-form surface is lofting, which may involve the interpolation of a set of curves or a set of multiply-connected by a smooth surface and may involve the use of splines as a mathematical solution.

BRIEF DESCRIPTION OF THE DRAWINGS

The accompanying drawings, which are incorporated in and constitute a part of this specification, illustrate various embodiments of the invention and, together with a general description of the invention given above and the detailed description of the embodiments given below, serve to explain the embodiments of the invention.

DETAILED DESCRIPTION

Figure 1:
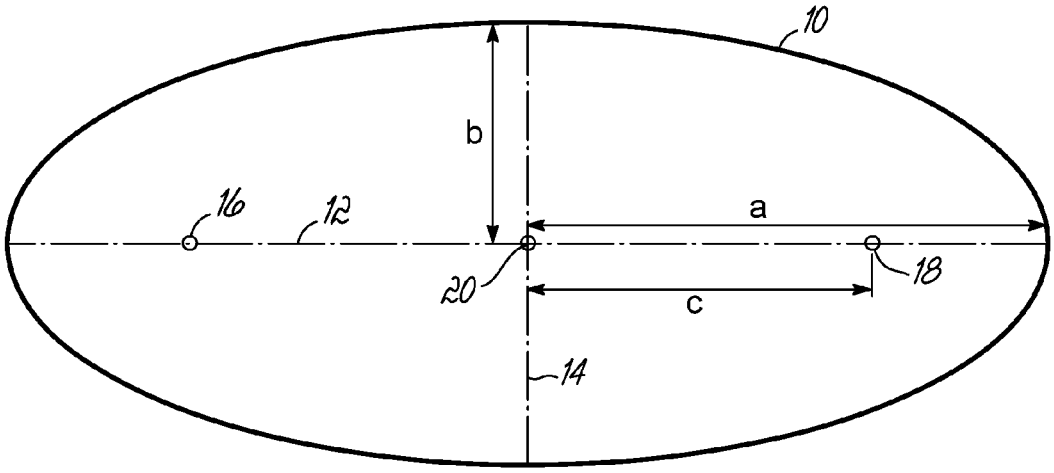
FIG. 1 is a schematic illustration of an ellipse and the mathematical parameters, and their relations that define the ellipse.

FIG. 1 illustrates an ellipse 10, which is a well known geometric shape. The ellipse 10 is generally defined by a major axis 12 and a minor axis 14 where a length of the major axis 12 is greater than a length of the minor axis 14. It is also well known that when the lengths of the axes 12, 14 are equal, then a special case of the ellipse, a circle, is created.

Along the major axis 12 are two points, or foci 16, 18, that are offset from a center 20 of the major axis 12. The foci 16, 18 are those points along the major axis 12 where the sum of the distances from any point along the boundary of the ellipse 10 to the foci 16, 18 is constant.

Another inherent feature of the foci 16, 18 that is known to those of ordinary skill in the art of optics is that a beam of light leaving one focus 16 will be reflected at the boundary of the ellipse 10 in a direction toward the other focus 18. In other words, light emitted from a point light source positioned at first focus 16 would be internally reflected by the ellipse and creates an aberration-free image at the second focus 18. With this feature in mind, and with reference to FIG. 2, the mechanics of a multifaceted reflector may be seen.

Figure 2:
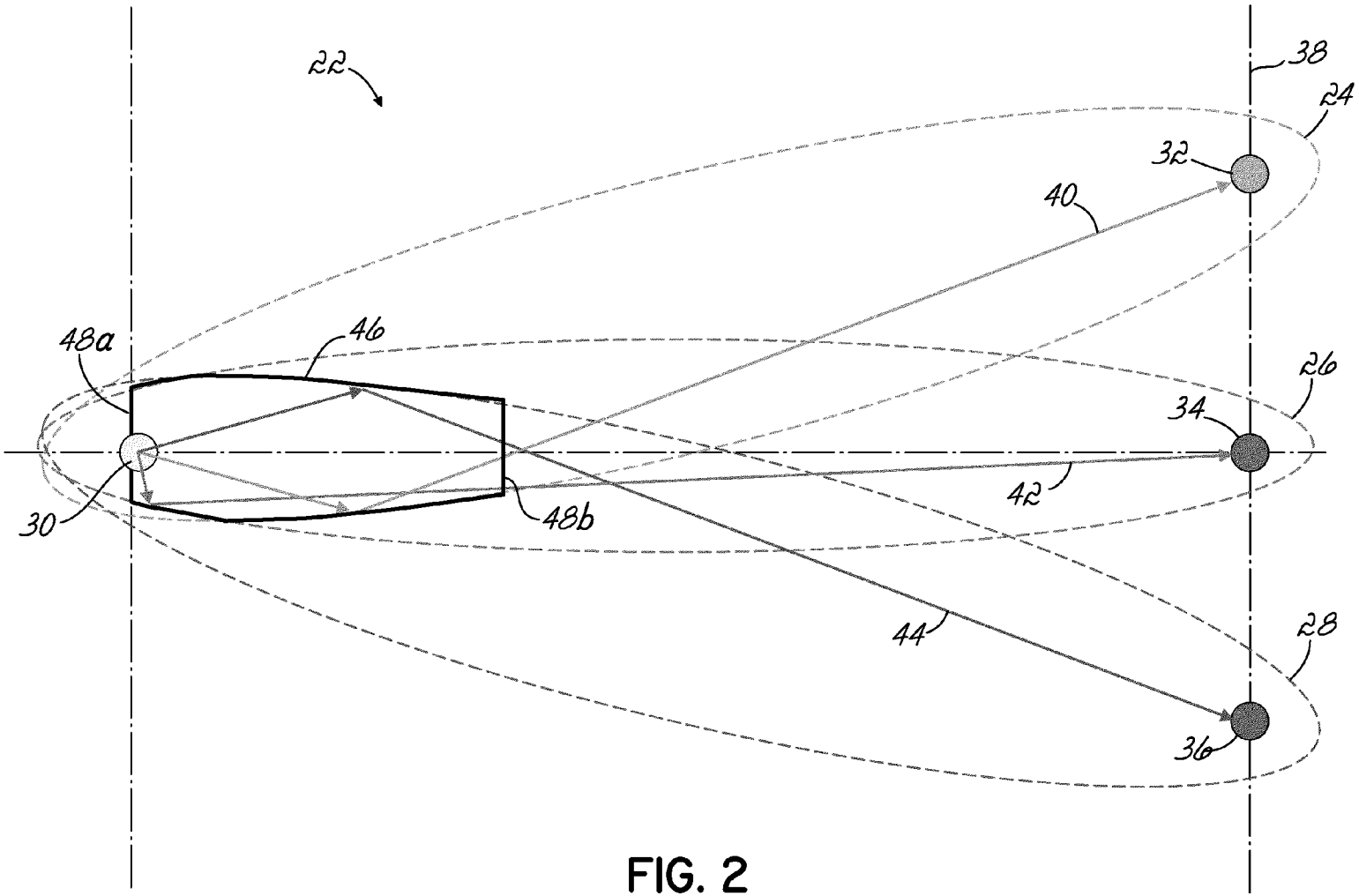
FIG. 2 is a schematic illustration of an ellipse system comprised of three ellipses sharing a common one focus and three separate second focuses on a common plane.

FIG. 2 illustrates an ellipse system 22 comprised of three ellipses 24, 26, 28 (illustrated in green, blue, and red, respectively), all sharing a common focus 30, and arranged such that the second foci 32, 34, 36 of each ellipse 24, 26, 28, respectively, are distinct, but lie on a common plane 38. A light source (not shown) that is positioned at the common focus 30 would send light in all directions away from the common focus 30 such that the light emitting in any direction, except light directly impacting the common plane, impacts an internal surface (i.e., a surface closest to the light source) belonging to one of the ellipses 24, 26, 28 at a point of reflection and is reflected to the respective second focus 32, 34, 36 of the reflecting ellipse 24, 26, 28 which is illustrated by respective vectors 40, 42, 44. As a result, three distinct and separate points of light may be created on the common plane 38 at positions that coincide with each of the second foci 32, 34, 36. The series of internal surfaces may be used to generate, in a manner described in greater detail below, a reflector housing 46 having a plurality of facets and where each facet is a segment or portion of one of the ellipses 24, 26, 28 of the ellipse system 22. The reflector housing 46 may include one or more openings (e.g., two diametrically opposed openings) for respectively allowing light to escape the reflector housing 46 and for providing access to the common focus 30 where the light source is located.

It would be understood that adjustments to the length of minor axis 14 (FIG. 1) of each of the three ellipses 24, 26, 28 may affect the area of reflection on the surface of the ellipse 24, 26, 28 and thus the amount of the reflected light that is incident onto the common plane 38 at the respective second focus 32, 34, 36.

It would also be readily appreciated by one of ordinary skill in the art that the number of points of light to be generated on the common plane 38 would be equal to the number of ellipses 24, 26, 28 comprising the ellipse system 22.

The ellipse system 22 may be modeled on a computing system. Briefly, an initial ellipse system 22 and an initial set of parameters characterizing the ellipse system 22 are established, where the ellipse system 22 is comprised of a plurality of ellipses 32, 34, 36 all sharing the common focus 30. While the size of each of the plurality of ellipses 32, 34, 36 comprising the initial ellipse system 22 may be arbitrarily established, initial parameters of each of the plurality of ellipses 32, 34, 36, for example, the minor axis 14 of each, are selected to establish a parametric baseline in order to reduce computational time. An initial reflector geometry is then generated from the initial parameters of this initial ellipse system 22. The process is iterated to generate a final reflector geometry with the desired design characteristics for a light intensity distribution map. With continued reference to FIGS. 1 and 2 and turning now also to FIGS. 3A and 3B where one exemplary method of modeling the ellipse system 22 and designing a resultant reflector are shown with greater detail.

Figure 3A:
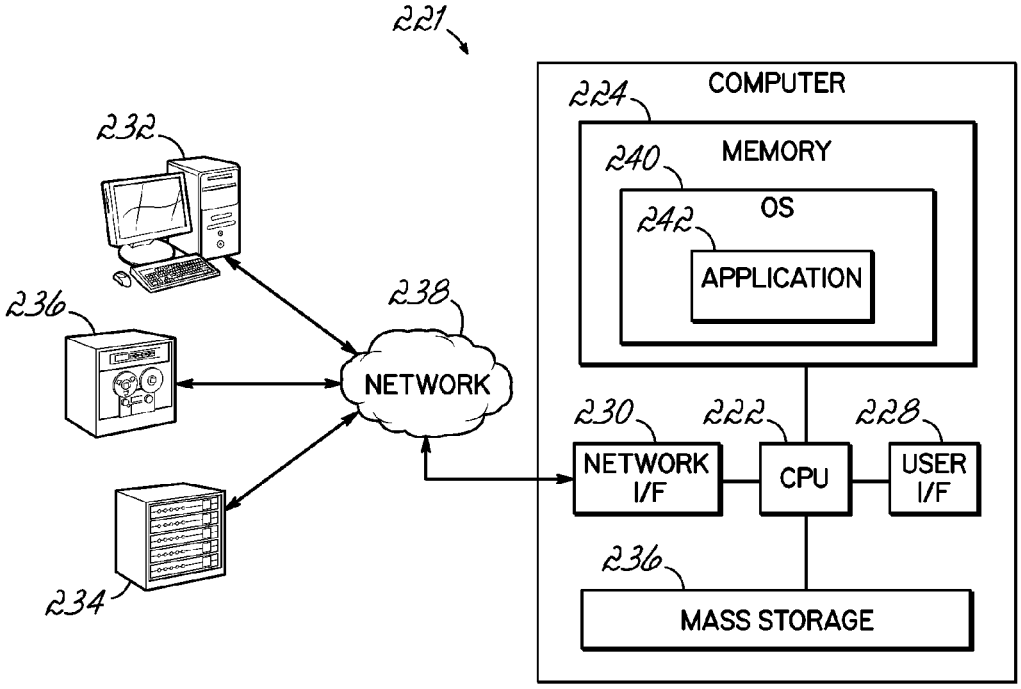
FIG. 3A is a schematic representation of an exemplary embodiment of a hardware and software environment for a computing system for modeling an ellipse system.

FIG. 3A illustrates a hardware and software environment for a computing system 221 that may be used in modeling the performance of the imaging reflector to determine the shapes of the different facets appropriate to produce a particular set of light spots on a screen. The computing system 221, for purposes of this invention, may represent any type of computer, computer system, computing system, server, disk array, or programmable device such as multi-user computers, single-user computers, handheld devices, networked devices, etc. The computing system 221 may be implemented using one or more networked computers, e.g., in a cluster or other distributed computing system. The computing system 221 will be referred to as "computer" for brevity sake, although it should be appreciated that the term "computing system" may also include other suitable programmable electronic devices consistent with embodiments of the invention.

The computer 221 may include at least one processing unit 222 (illustrated as "CPU") coupled to a memory 224 along with several different types of peripheral devices, e.g., a mass storage device 226, a user interface 228 (including, for example, user input devices and a display), and a network interface 230. The memory 224 may be comprised of dynamic random access memory (DRAM), static random access memory (SRAM), non-volatile random access memory (NVRAM), persistent memory, flash memory, at least one hard disk drive, and/or another digital storage medium. The mass storage device 226 is typically at least one hard disk drive and may be located externally to the computer 221, such as in a separate enclosure or in one or more networked computers 232, one or more networked storage devices 234 (including, for example, a tape drive), and/or one or more other networked devices 136 (including, for example, a server). The computer 221 may communicate with the networked computer 232, networked storage device 234, and/or networked device 236 through a network 238.

As illustrated in FIG. 3A, the computer 221 includes a processing unit 222, which, in various embodiments, may be a single-thread, multithreaded, multi-core, and/or multi-element processing unit as is well known in the art. In alternative embodiments, the computer 221 may include a plurality of processing units 222 that may include single-thread processing units, multithreaded processing units, multi-core processing units, multi-element processing units, and/or combinations thereof as is well known in the art. Similarly, memory 224 may include one or more levels of data, instruction and/or combination caches, with caches serving an individual processing unit or multiple processing units as is well known in the art. In some embodiments, the computer 221 may also be configured as a member of a distributed computing environment and communicate with other members of that distributed computing environment through the network 238.

The memory 224 of the computer 221 may include an operating system 240 to control the primary operation of the computer 221 in a manner that is well known in the art. In a specific embodiment, the operating system 240 may be a Unix-like operating system, such as Linux. The memory 224 may also include at least one application 242, or other software program, configured to execute in combination with the operating system 240 and perform a task. It will be appreciated by one having ordinary skill in the art that other operating systems may be used, such as Windows, MacOS, or Unix-based operating systems, for example, Red Hat, Debian, Debian GNU/Linux, etc.

In general, the routines executed to implement the embodiments of the invention, whether implemented as part of an operating system or a specific application, component, algorithm, program, object, module or sequence of instructions, or even a subset thereof, will be referred to herein as "computer program code" or simply "program code." Program code typically comprises one or more instructions that are resident at various times in memory and storage devices in a computer, and that, when read and executed by at least one processor in a computer, cause that computer to perform the steps necessary to execute steps or elements embodying the various aspects of the invention.

Various program code described hereinafter may be identified based upon the application or software component within which it is implemented in specific embodiments of the invention. However, it should be appreciated that any particular program nomenclature that follows is merely for convenience; and thus, the invention should not be limited to use solely in any specific application identified and/or implied by such nomenclature. Furthermore, given the typically endless number of manners in which computer programs may be organized into routines, procedures, methods, modules, objects, and the like, as well as the various manners in which program functionality may be allocated among various software layers that are resident within a typical computer (e.g., operating systems, libraries, Application Programming Interfaces [APIs], applications, applets, etc.), it should be appreciated that the invention is not limited to the specific organization and allocation of program functionality described herein.

As will be appreciated by one skilled in the art, the embodiments of the present invention may also take the form of a computer program product embodied in at least one computer readable storage medium having computer readable program code embodied thereon.

The computer readable storage medium may be an electronic, magnetic, optical, electromagnetic, infrared, or semiconductor system, apparatus, or device, or any suitable combination thereof, that can contain, or store a program for use by or in connection with an instruction execution system, apparatus, or device. Exemplary computer readable storage medium include, but are not limited to, a hard disk, a floppy disk, a random access memory, a read-only memory, an erasable programmable read-only memory, a flash memory, a portable compact disc read-only memory, an optical storage device, a magnetic storage device, or any suitable combination thereof. Computer program code for carrying out operations for the embodiments of the present invention may be written in one or more object oriented and procedural programming languages.

The methods described herein for designing a reflector can be implemented by computer program instructions supplied to the processor of any type of computer to produce a machine with a processor that executes the instructions to implement the functions/acts specified herein. These computer program instructions may also be stored in a computer readable medium that can direct a computer to function in a particular manner To that end, the computer program instructions may be loaded onto a computer to cause the performance of a series of operational steps and thereby produce a computer implemented process such that the executed instructions provide processes for implementing the functions/acts specified herein.

Those skilled in the art will recognize that the environment illustrated in FIG. 3A is not intended to limit the present invention. Indeed, those skilled in the art will recognize that other alternative hardware and/or software environments may be used without departing from the scope of the invention.

Figure 3B:
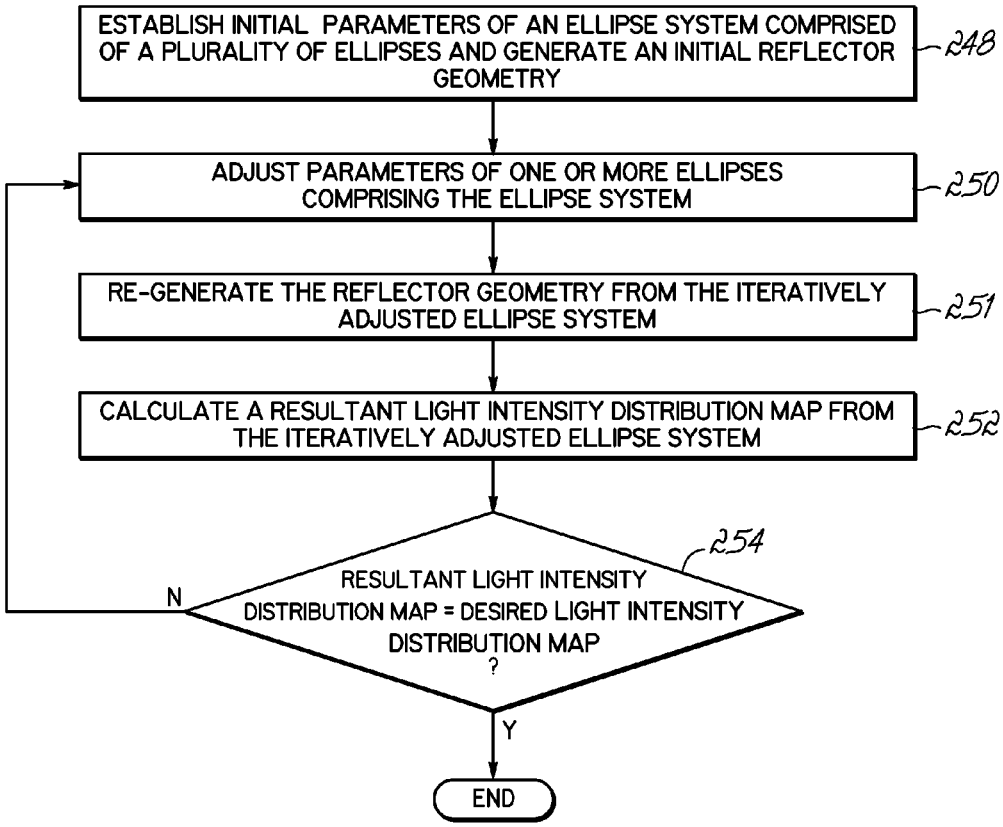
FIG. 3B is a flow-chart illustrating one method for modeling an ellipse system and determining a resultant reflector shape for generating an image.

The simulation according to an embodiment of the present invention for modeling of the ellipse system 22 and for determining a resultant shape of a reflector, and the method for such modeling, will now be described with reference to FIG. 3B and continued reference to FIG. 2. While specific reference to the ellipse system 22 is made throughout the description of the method embodiment, it would be understood that the reference is merely for convenience of illustrating the method, and the method should not be limited to any particular embodiment of an ellipse system shown or described herein.

In block 248, an ellipse system and an initial set of parameters for the ellipse system are established, where the ellipse system is comprised of a plurality of ellipses all sharing the common focus. While the size of each of the plurality of ellipses comprising the initial ellipse system may be arbitrarily established, one of ordinary skill in the art would understand how to tailor initial parameters of each of the plurality of ellipses, for example, the minor axis of each, to establish an educated guess in order to reduce computational time. An initial reflector geometry is then generated from the initial parameters of this ellipse system.

In block 250, parameters of one or more of the plurality of ellipses comprising the ellipse system are iteratively adjusted. Each of the plurality of ellipses has one independent parameter—minor axis 14 ("b" in FIG. 1). As far as location of the foci 16, 18 are fixed, the value for the major axis 12 ("a" in FIG. 1) should be calculated in accordance with the equation associate with FIG. 1.

In block 251, a reflector geometry is then re-generated from the parameter-adjusted ellipse system. A resultant distribution map of the light intensity is calculated from the ellipse system profile, in block 252.

In block 254, a decision is made as to whether the calculated resultant distribution map of the light intensity is equal to a desired distribution map of the light intensity in terms of two-dimensional shape, image size, illumination uniformity, spot size, and so forth. One of ordinary skill in the art would readily appreciate that the decision could be extended to accept a light intensity distribution map that is within a specified standard deviation of the desired light intensity distribution map. If the resultant light intensity distribution map is not satisfactorily similar to the desired light intensity distribution map, then the process returns to block 250 to further iterative adjustments to the ellipse system are made. Otherwise, the modeling ends.

With the calculated resultant light intensity distribution map satisfactorily determined, the shape and parameters of the ellipse system used in calculating the satisfactory resultant light intensity distribution map are used to manufacture a reflector that is capable of generating the light intensity distribution map. In one embodiment, a mold for a reflector may be generated from the light intensity distribution map. In another embodiment, instructions for generating the shape of the reflector may be communicated to a The reflector, which is shown and described in yet greater detail below, is constructed such that an inner surface of the reflector is faceted, the facets being formed from the intersecting surfaces of the plurality of ellipses that are sharing the common focus. As a result, each of the facets has a shape that includes at least a portion of an ellipse that is sharing the common focus.

Parameters of one or more of the plurality of ellipses comprising the initial reflector geometry is iteratively adjusted. Each of the plurality of ellipses has one independent parameter—minor axis 14 ("b" in FIG. 1) as location of the second foci 32, 34, 36 are fixed and the value for the major axis 12 ("a" in FIG. 1) should be calculated in accordance with equation on FIG. 1. An adjusted reflector geometry is then generated from the iteratively adjusted ellipse system and a resultant illumination profile is calculated from the adjusted reflector geometry. If the resultant illumination distribution is sufficiently similar to a desired illumination distribution (i.e., within a specific standard deviation), then the adjusted reflector geometry is accepted for construction of the reflector. Otherwise, one or more parameters of one or more of the plurality of ellipses 24, 26, 28 is further iteratively adjusted and a new reflected geometry generated for similar analysis.

The interactive process of designing a reflector shape involves a software algorithm based on an optical software package, such as LightTools (Optical Research Associates, Inc), used to simulate reflector performance and a CAD software package, such as SolidWorks (Dassault Systems), used to develop a model. The algorithm maintains parameters of a plurality of elliptical shapes and provides logic to build a reflector shape based on these ellipses. A model of the reflector shape may be imported into the optical software package to conduct raytracing, which simulates the intensity distribution on a screen for light coming from the reflector. Based on the results of this optical simulation, parameters of plurality of elliptical shapes can be modified and the process of building a model of reflector shape and testing the reflector shape with the optical software package may be repeated. The interactive design process stops when optical simulation of the light distribution on the screen meets or exceeds the design requirements for the reflector.

With a final reflector geometry satisfactorily determined, the shape and parameters of the ellipse system 22 used in calculating the final reflector geometry are used to create a mold for manufacturing a reflector body that is capable of generating the desired illumination profile. The reflector body 46, which is shown and described in yet greater detail below, is constructed such that an inner surface of the reflector is faceted, where the facets are formed from the intersecting surfaces of the plurality of ellipses 24, 26, 28 sharing a common focus 30. As a result, each of the facets has a shape that includes at least a portion of an ellipse 24, 26, 28 that is sharing the common focus 30.

Manufacture of the reflector body 46 may be accomplished by filling the mold with a suitable polymeric material (acrylics, polycarbonate, polyesters, polyethylene, and so on) and curing, if necessary. The reflector body 46 may be constructed simply as a unitary structure from the polymeric material, therefore having minimal costs as compared to conventional imaging and illumination systems having separate lenses and objects. The single unit reflector body 46 therefore is capable of collecting light from a light source and distributing that light for illumination. The reflector body 24 may also be formed from a glass or a metal.

Alternative types of technology, such as electroforming and thermoforming, may be used to manufacture the reflector. The reflective surface may also be machined, for example, on diamond single point CNC equipment with Slow Tool Servo capability for cutting and shaping free form surfaces.

Figure 4A:
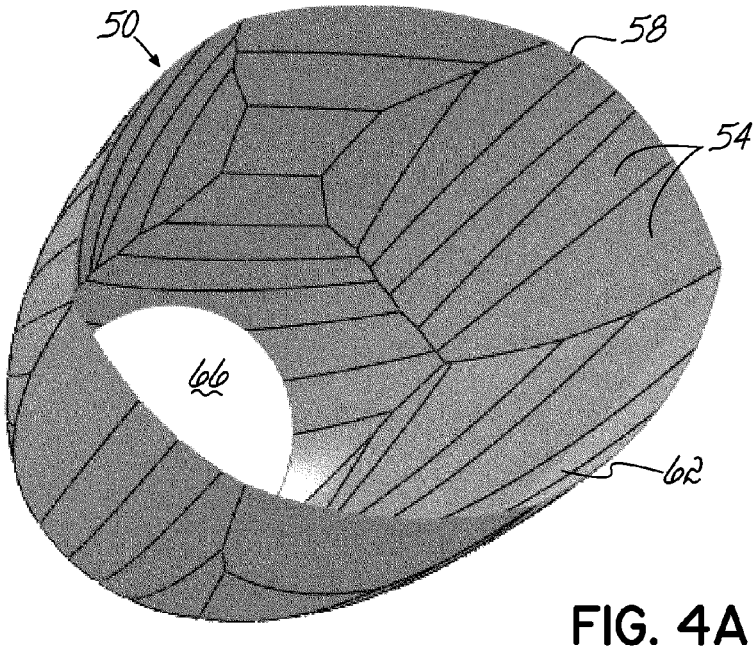
FIG. 4A is a side elevational view of a hollow reflector made in accordance with one embodiment of the present invention.
Figure 4B:
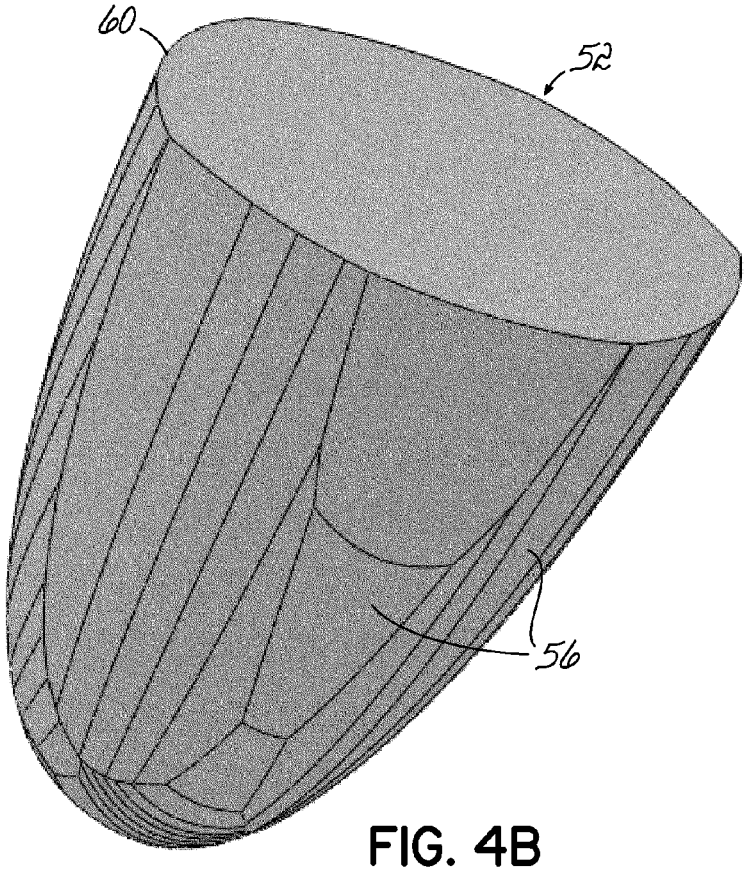
FIG. 4B is a side elevational view of a solid reflector made in accordance with another embodiment of the present invention.

FIGS. 4A and 4B illustrate two exemplary reflector body shapes: a hollow reflector body 50 or a solid reflector body 52. Each reflector body 50, 52 includes a housing having a plurality of facets 54, 56, respectively. Each facet 54, 56 may have an elliptical shape or may be approximated with one or more small and flat (i.e., planar) facet segments. Both reflectors bodies 50, 52 include an end 58, 60, respectively, that is created by a cross-sectional cut through the final reflector body geometry and through which reflected light exits the reflector body 50, 52. The hollow reflector body 50 includes an inner surface 62 that may be polished and coated with a reflective material, (for example, various metals or multilayer reflective coating) to reflect the light. One of ordinary skill in the art would appreciate that the solid reflector body 52 operates in accordance with Total Internal Reflections (TIR), which occurs at the boundary between two media, here the material comprising of the solid reflector body 52 and the air external to the solid reflector body 52. Light that is incident onto the inner surface (not shown) is reflected completely within the solid reflector body 52.

Figure 5:
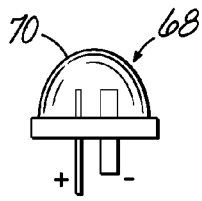
FIG. 5 is a schematic illustration of a light emitting diode operable as a light source for the reflector of FIG. 4A.

An opening 66 is positioned at the closed end (opposite the cut ends 58, 60) of each reflector body 50, 52, though this is not specifically shown in the solid reflector body 52. The opening 66 allows a light source to be positioned at the common focus 30 (FIG. 2). One suitable light source may be a light emitting diode (LED) 68, such as the one schematically shown in FIG. 5. LEDs 68 are well known and generally include a cathode (designated with a plus sign +), and anode (designated with a minus sign −), a doped semi-conductor material (not shown), and an epoxy dome 70. Selection of the doping material determines the color (wave length) emitted by the LED 68. The light source should be selected to have a relatively small volume from which the light is emitted such that the light may be emitted from the common focus 30 (FIG. 2) and considered to be a point light source. Conventional light sources, such as fluorescent or incandescent light bulbs, are much too large in volume to be considered to be point light sources.

Suitable LEDs 68 may include those ranging in size of light emitting area from about 1 mm to about 25 mm, but should not be limited to only these sizes. An array of individual LEDs assembled on common base can also be used. Suitable constructions for the LED 68 include, but are not limited to, a white LED, a color LED, or a multi-color LED, as these constructions are understood. In alternative embodiments, the LED 68 can be replaced by other types of light sources such as an organic light emitting diode (OLED), a laser diode, an arc lamp, an Ultra High Pressure (UHP) lamp, a high-intensity discharge (HID), etc.

Figure 6:
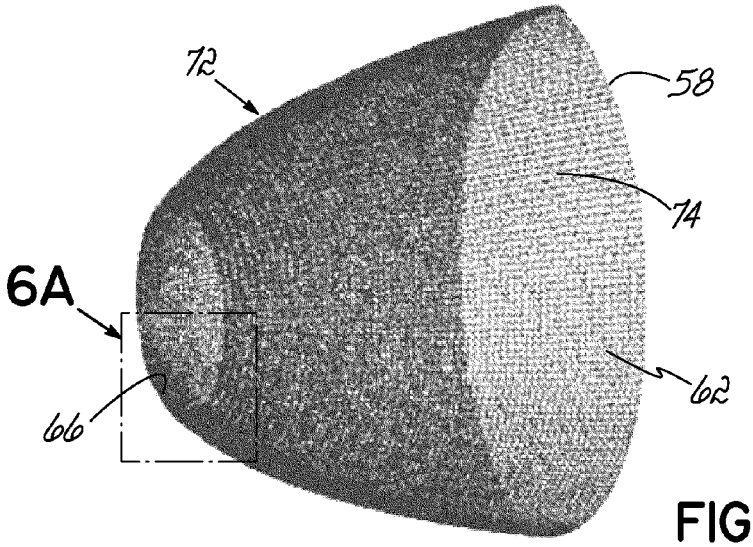
FIG. 6 is a side elevational view of a model of a hollow reflector body in accordance with an embodiment of the present invention.
Figure 6A:
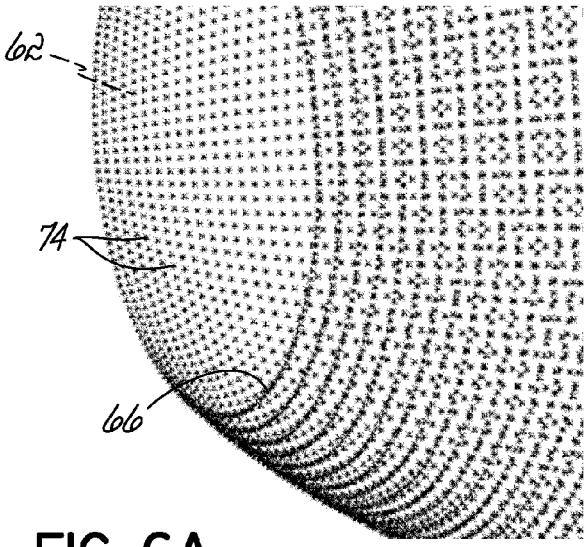
FIG. 6A is an enlarged view of a portion of FIG. 6.
Figure 7:
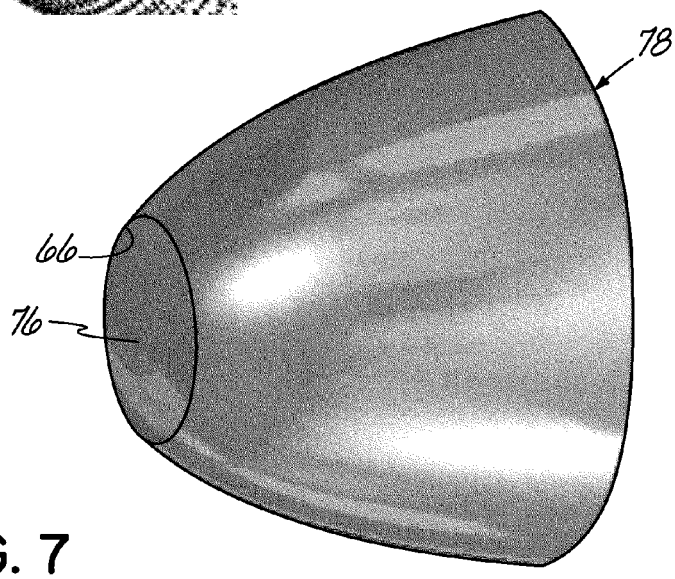
FIG. 7 is a hollow reflector body constructed in accordance with the model of FIG. 6.

In some embodiments it may be advantageous to eliminate the distinct, abrupt boundaries between adjacent facets 54 of the hollow reflector body 50 (FIG. 4A, 4B) which in actuality may present themselves as a small radius at the vertex boundary. FIGS. 6-7 illustrate one manner of smoothing the inner surface 62 of the hollow reflector body 50 of FIG. 4A. FIG. 6 is a model 72 is created of the hollow reflector body 50 (FIG. 4A) having its surface populated with a specified number of points 74 per unit of the area along the inner surface 62 which is shown in greater detail in FIG. 6A. A spline curve is then fit through all of the points in each cross-sectional plane. With a sufficient number of points 74, the inner surface 62 having facets 54 is replaced with a smooth free-form surface 76 of a final reflector body 78, as shown in FIG. 7, which is generated as the best fit to the plurality of facets 54. In some embodiments, a lofted surface through all spline lines in all cross-sections may provide optimal results.

Figure 8:
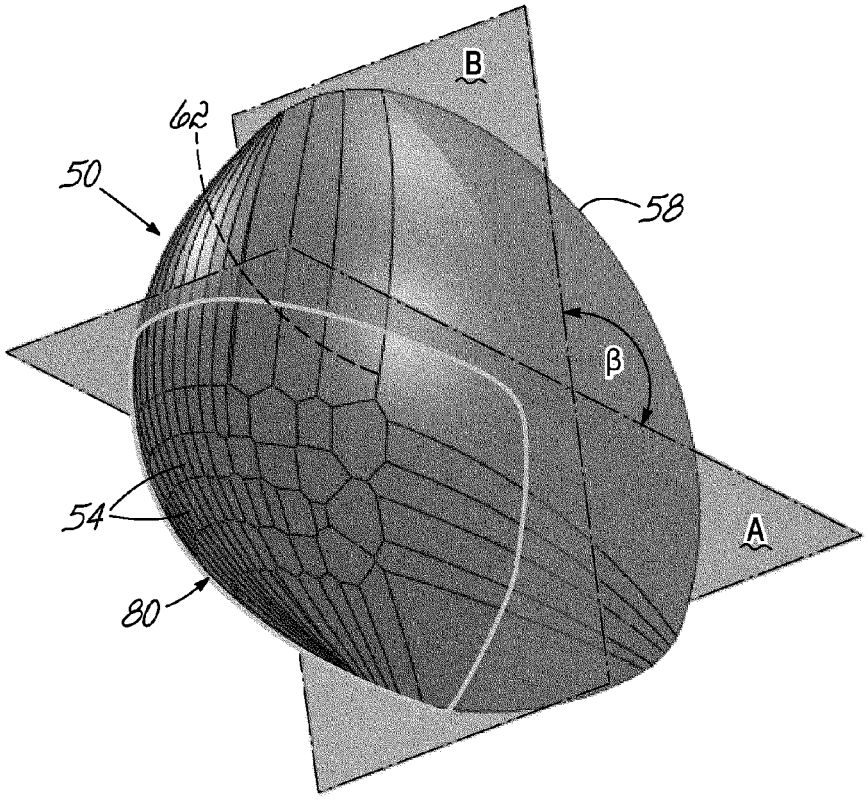
FIGS. 8-10 are side-elevational views of a reflector body made in accordance with another embodiment of the present invention.
Figure 9:
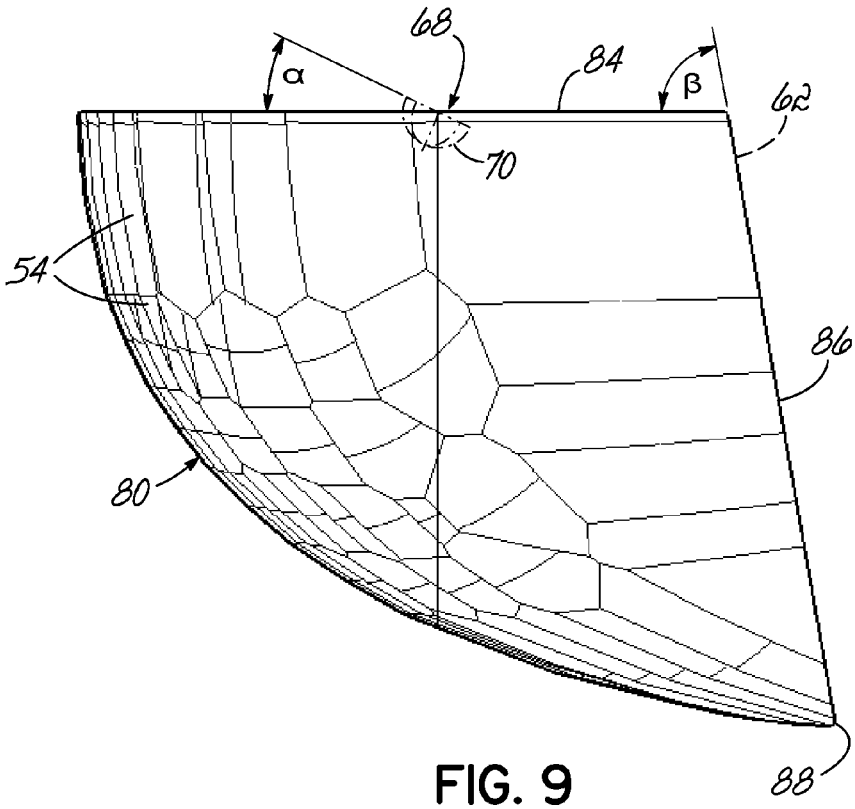
Figure 10:
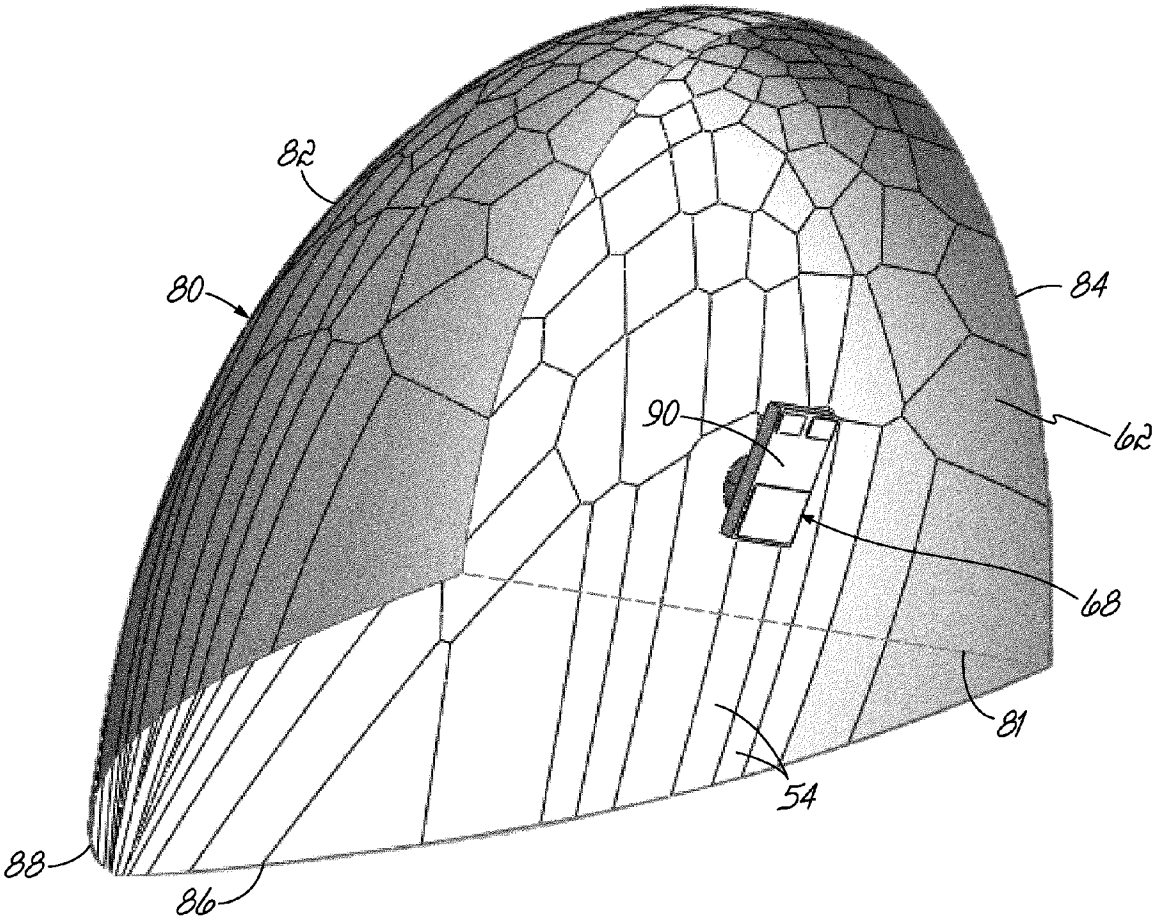

FIGS. 8-10 illustrate a further adaptation of the hollow reflector body 50 to generate a skew faceted elliptical reflector housing 80 ("reflector"), in accordance with one embodiment of the present invention. Formation of the reflector 80 begins with placement of two planes (designated as "A" and "B," respectively) so as to intersect the hollow reflector 50 and cross within the body of the hollow reflector body 50. Said another way, the planes A, B intersect along a line 81 (FIG. 10) that lies within the volume of the hollow reflector 50, The remaining portion of a hollow reflector body 50 is the reflector 80 (outlined in orange) according to one embodiment of the present invention. The reflector 80 is shown in greater detail in FIG. 9 and includes a first surface 84 generated by the Plane A and a second surface 86 generated by the Plane B. While the first surface 84 is shown as a horizontal plane in the illustrative embodiment, in other embodiments, the first surface 84 may be a tilted plane. Because the particular embodiment starts with the hollow reflector body 50, the first and second surfaces 84, 86 may be first and second edges. It would be readily understood that the lofted or spline surface fitting and smoothing of the inner surface 62 may be completed before or after formation of the reflector 80.

While not specifically shown, another embodiment of a skew faceted elliptical reflector housing may be constructed from the solid reflector body 52 (FIG. 4B). Accordingly, the first and second surfaces would be a planar surface as opposed to an edge, which was described with reference to the hollow reflector body 50.

The light source, illustrated in FIG. 9 as the LED 68 is positioned at the point where all elliptical shapes have common focus and directed toward the reflective surface 80. In this way, light emitted by the LED 68 is reflected by the reflective inner surface 62 and exits via the first and/or second surfaces 84, 86. The LED 68 may be angularly oriented relative to the reflective inner surface 62, that is to say, the LED 68 may be oriented relative to the plane of the first surface 84, by an angle $\alpha$, where angle $\alpha$ may range from about 0° to about 45°. This angular orientation and selection of $\alpha$ affects the amount of light incident a given area of the inner surface 80 and, thus, the directionality and intensity of light reflected from the reflector 80.

Referring still to FIGS. 8 and 9, the angled intersection between first surface 84 (Plane A) and second surface 86 (Plane B) may be selected to customize the amount of light capable of leaving the reflector 80 in the direction of target (target is not shown in FIGS. 8 and 9). For example, with acute angles of intersection (i.e., $\beta<90°$), the likelihood that reflected light will impact a distal edge 88 of the reflector 80 is decreased as compared to obtuse angles (i.e., $\beta>90°$). However, acute angles may also decrease the total area of the inner surface 62 that is available for reflecting light. Thus, the selection of $\beta$ should be optimized in the computer model, along with the design of the reflector geometry, described in detail above. Typically, the angle $\beta$ may range from about 90° to about 150°, but in some embodiments, $\beta$ may be as high as about 165°.

In FIG. 10, the reflector 80 is rotated such that the position of the LED 68 relative to the inner surface 62 is more clearly shown. The LED 68 is mounted onto a support 90, which may include a heat sink and electrical connectors (not shown) for operating the LED 68.

Figure 11:
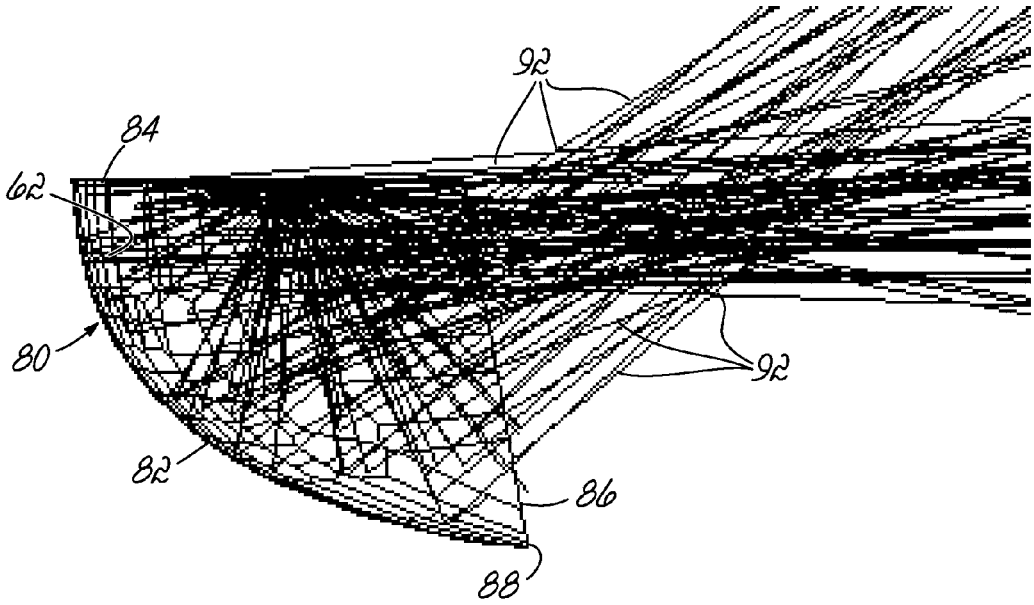
FIGS. 11 and 11A are diagrammatic views of light rays reflected by the reflector of FIGS. 8-10.

FIG. 11 illustrates a plurality of vectors 92 representing various rays of light emitted by the LED 68 (FIG. 9), reflected by the inner surface 62, and exiting through the first and second surfaces 84, 86. By expanding the field of view, such as shown in FIG. 11A, it is readily appreciated that the reflector 80 is operable to illuminate a large surface area, or creates a flood illumination, on a target surface 94.

Figure 11A:
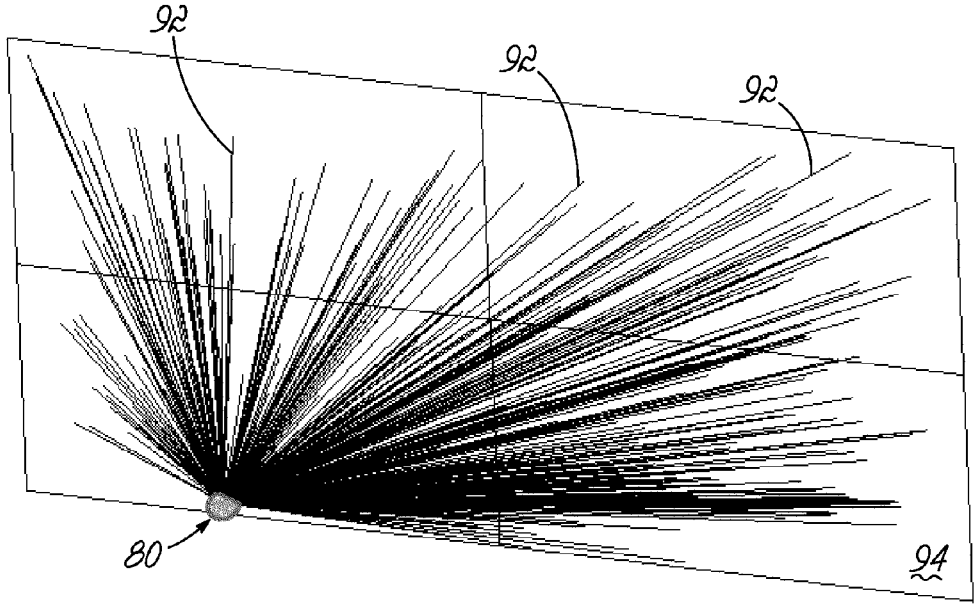
Figure 12A:
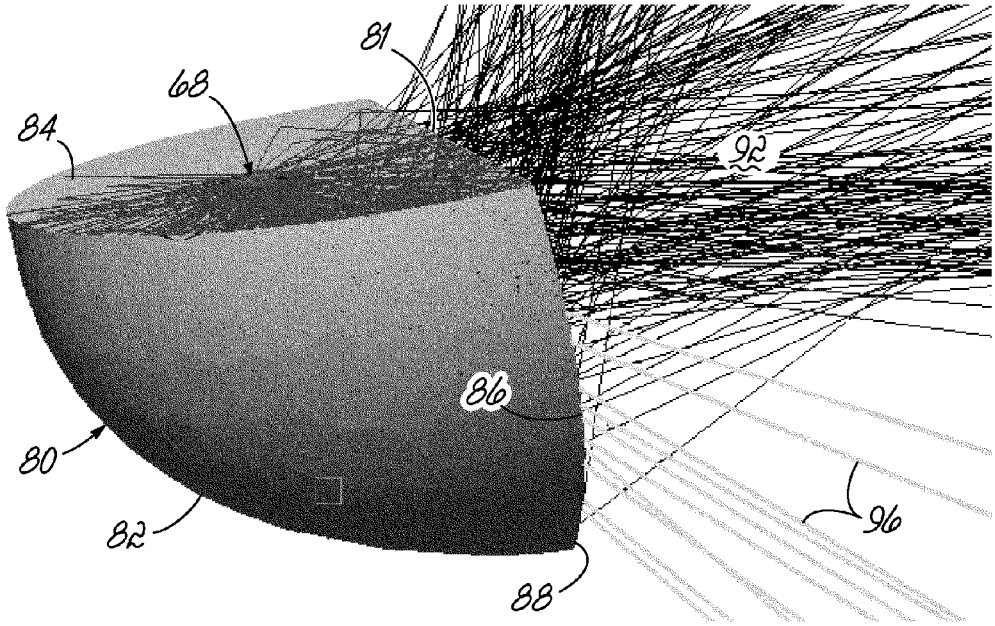
FIGS. 12A and 12B are diagrammatic views of light rays reflected by the reflector of FIGS. 8-10 that illustrate light loss of direct light exiting the reflector.
Figure 12B:
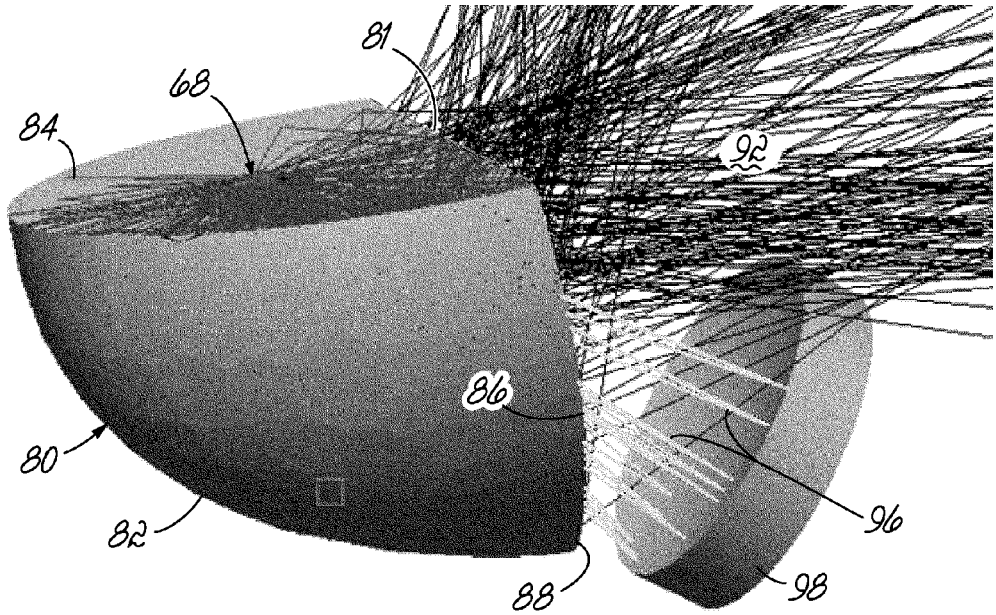

Referring now to FIG. 12A, there may be some loss of light 96 (illustrated in green) through direct light leaving the reflector 80 without interference with the reflecting inner surface (not shown in FIG. 12A), which are those vectors 92 that will not impact the target surface 94 (FIG. 11A). When there is an increase in direct light 96, then the reflector 80 is considered to be less efficient. Accordingly, in some embodiments and as shown in FIG. 12B, a mirror 98 may be positioned outside the reflector 80 to redirect the aberrant light 96 back into the reflector 80 such that it may again be reflected at the inner surface 62 (FIG. 11) and toward the target surface 94. The size and shape of the mirror 98 can vary greatly and may be determined, at least in part, by the dimensions most easily accommodated by the reflector 80. Additionally, one skilled in the art would readily appreciate that angle formed between the mirror 98 and the second surface 86 may be altered in order to properly direct the aberrant light 96 toward the inner surface 62 (FIG. 11).

Figure 13:
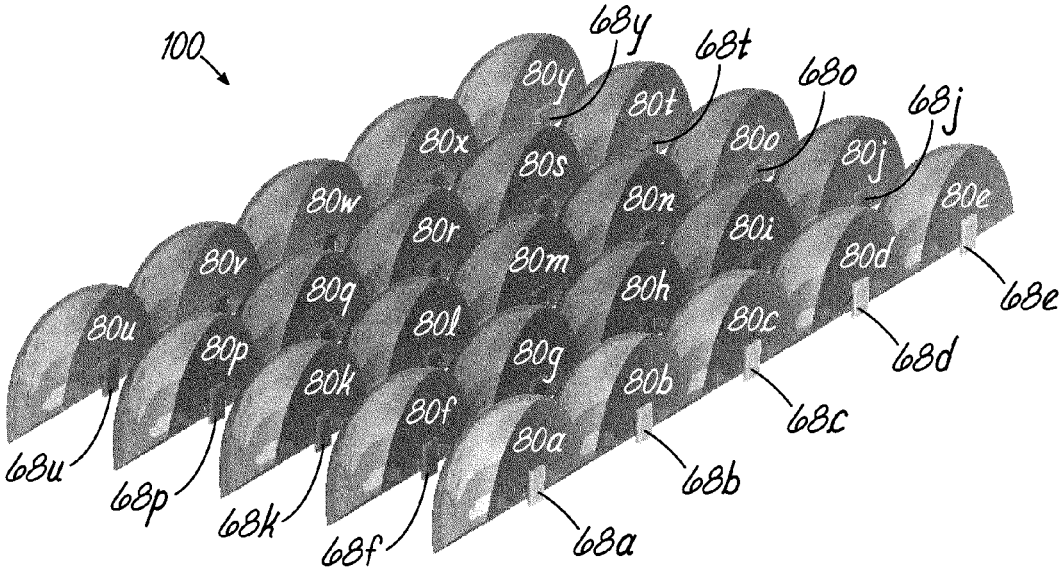
FIG. 13 is a perspective view of a side reflector system in accordance with an embodiment of the present invention.
Figure 14:
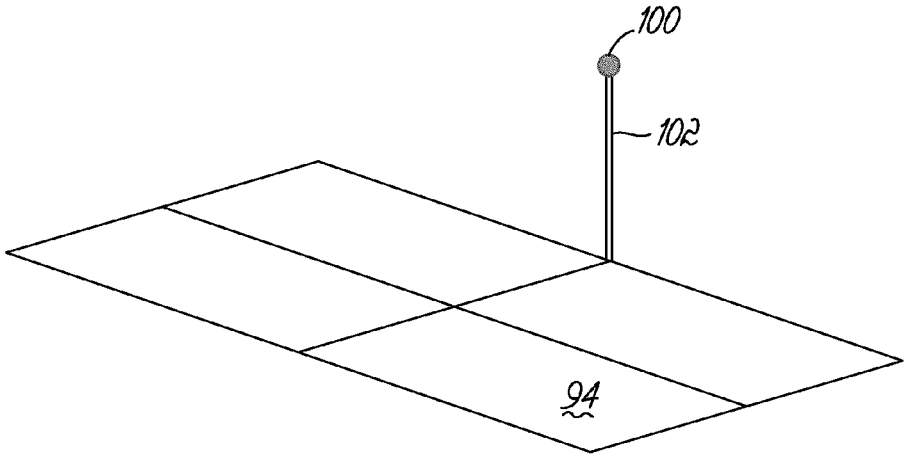
FIG. 14 is a diagrammatic view illustrating the orientation of the entire target area and the side reflector system of FIG. 13.

The reflector 80, with its unique ability to provide flood illumination of a large area, makes this geometry widely adaptable for use as a side reflector system 100, which is shown with greater detail in FIG. 13. The side reflector system 100 includes a number, n, of the reflectors 80 (illustrated as $\mathbf{80}_a$-$\mathbf{80}_y$, referred to generally as $\mathbf{80}_n$) arranged in a one- or two-dimensional array. Each reflector $\mathbf{80}_n$ includes a light source, again illustrated as the LED $\mathbf{68}_n$ (where n ranges from a-y). The light sources $\mathbf{68}_n$ of each of the reflectors $\mathbf{80}_n$ may be electrically driven and controlled individually, controlled as a whole unit or as the system 100, or controlled as a subunit where the total number of reflectors 80 is divided into two or more subunits (for example, by row or by column). Because of each of reflectors $\mathbf{80}_n$ of the system 100 cause illumination of the entire target area 94 (FIG. 14), the need for precise alignment of each reflector $\mathbf{80}_n$ is greatly diminished as compared to the conventional flood illumination designs. This results in a more simplified construction and saves costs. Accordingly, the reflectors 80*n* may be mounted onto or into a support (not shown) to create a unitary structure containing all of the necessary hardware and components. The support may be mounted onto a post 102 or otherwise mounted at an elevated height, offset from the center of the target surface 94, as shown in FIG. 14.

Example 1

Figure 15A:
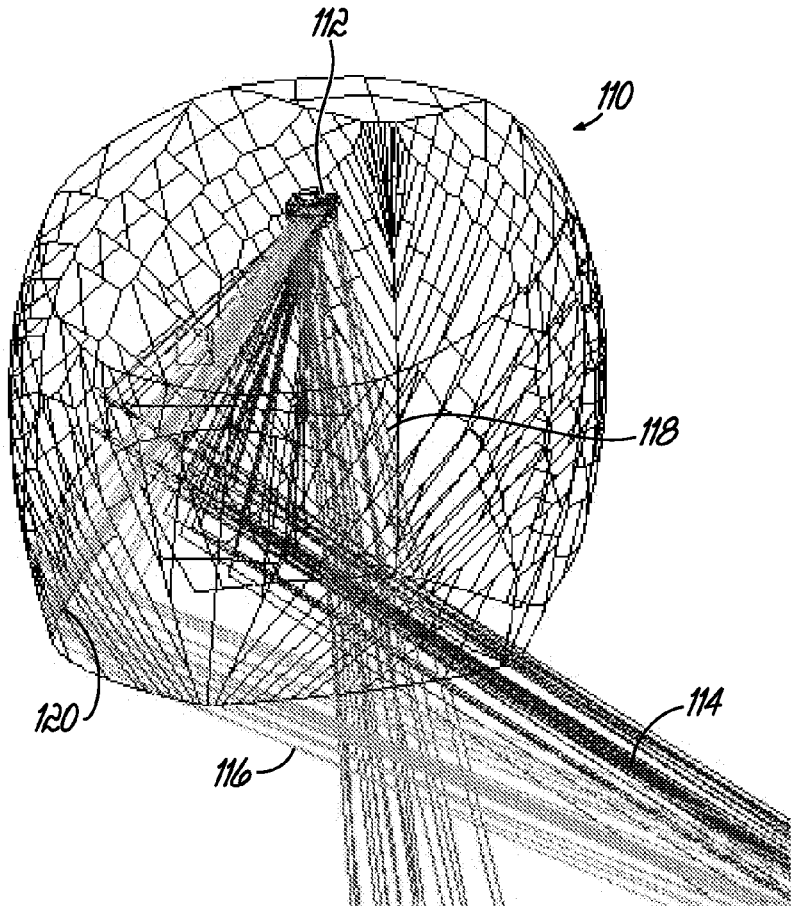
FIG. 15A is a diagrammatic view illustrating a multi-facet reflector constructed in accordance with an embodiment of the invention.
Figure 15B:
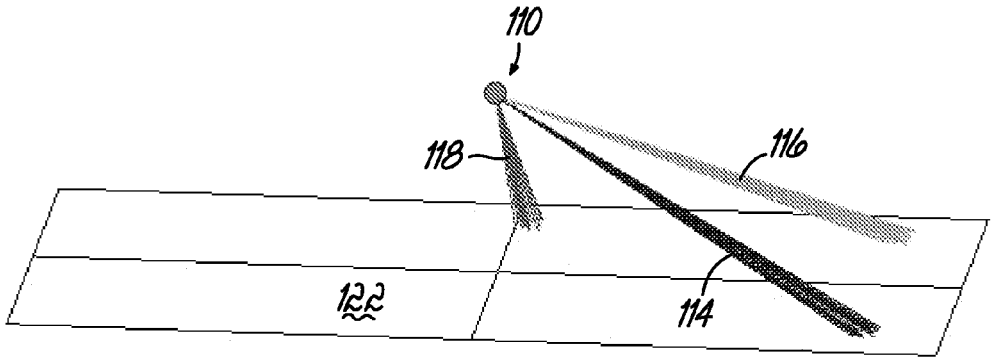
FIG. 15B is a diagrammatic view illustrating the use of the reflector of FIG. 15A as a flood reflector.

FIG. 15A illustrates a multi-facet reflector 110 constructed in a manner described in Magarill, S., "Anamorphic illuminator," Proceedings of SPIE Vol. 7785, 77850I (2010), which is hereby incorporated by reference herein in its entirety. The reflector 110 includes an LED 112 for emitting light. While light is emitted in all directions, three zones of light from the reflector 110 are shown: a first reflected light 114 (illustrated in blue), a second reflected light 116 (illustrated in green), and a direct light 118 (also referred to as incident light and illustrated in red) that is not reflected by an inner surface 120 of the multi-facet reflector 110. FIG. 15B illustrates the use of the reflector 110 as a flood reflector and the relative positions of the light 114, 116, 118 projected onto a target surface 122.

Figure 15C:
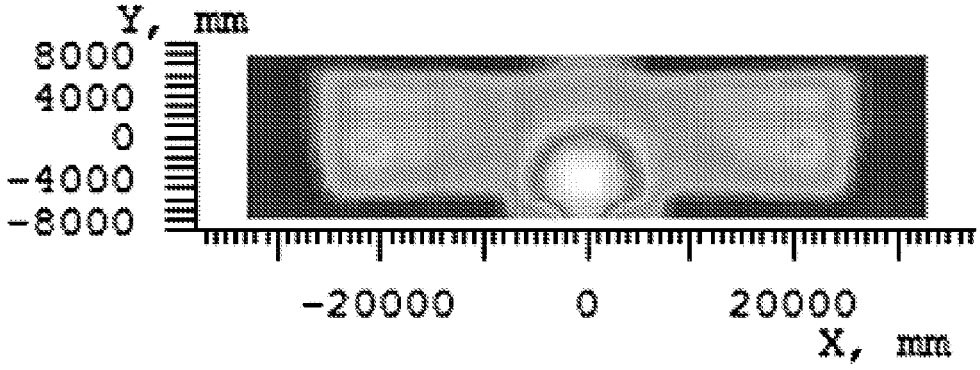
FIG. 15C is a color-coded distribution map of the light intensity from the reflector of FIG. 15A on a large target surface.
Figure 15D:
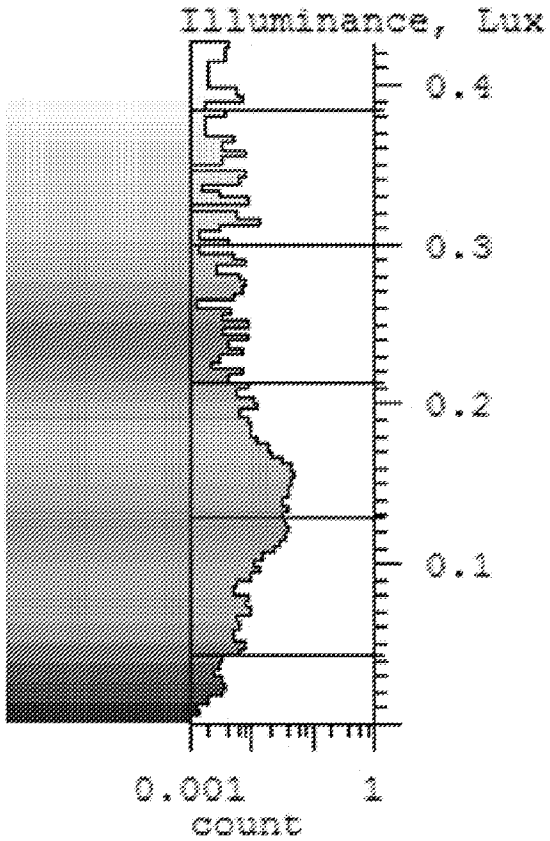
FIG. 15D is a histogram of the light intensity distribution of the distribution map in FIG. 15C.

As can more clearly seen in FIG. 15C, which is a color-coded distribution map of the light intensity impinging the large target surface 122, a distinct "hot spot" (the white spot at x=0 mm) is generated by the direct light 118 having an intensity that is more than twice the intensity of the remaining portions of the target surface 122. The hot spot cannot be off-set with indirect or reflected light. FIG. 15D is a histogram of the light intensity distribution of the distribution map shown in FIG. 15C. The result is that a majority of the target surface 122 has an illuminance of about 0.12 lux to about 0.17 lux when the illuminance of the hot spot is near 0.35-0.4 lux.

Example 2

Figure 16A:
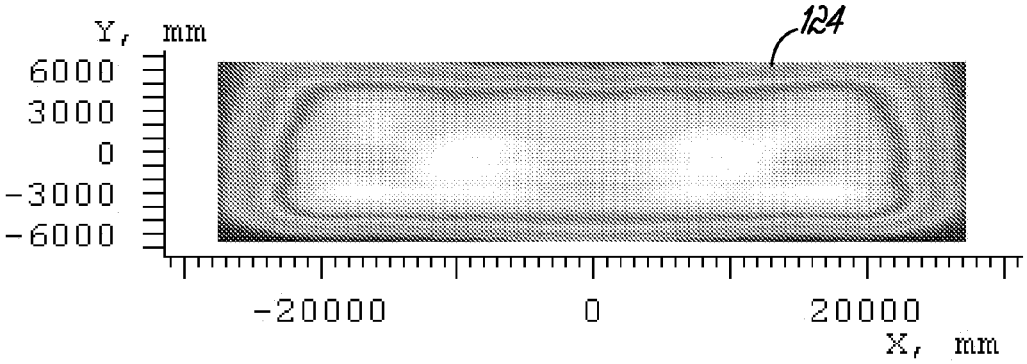
FIG. 16A is a color-coded distribution map of the light intensity for a large target surface resulting from a side reflector system constructed in a manner that is similar to the system of FIGS. 8-10.
Figure 16B:
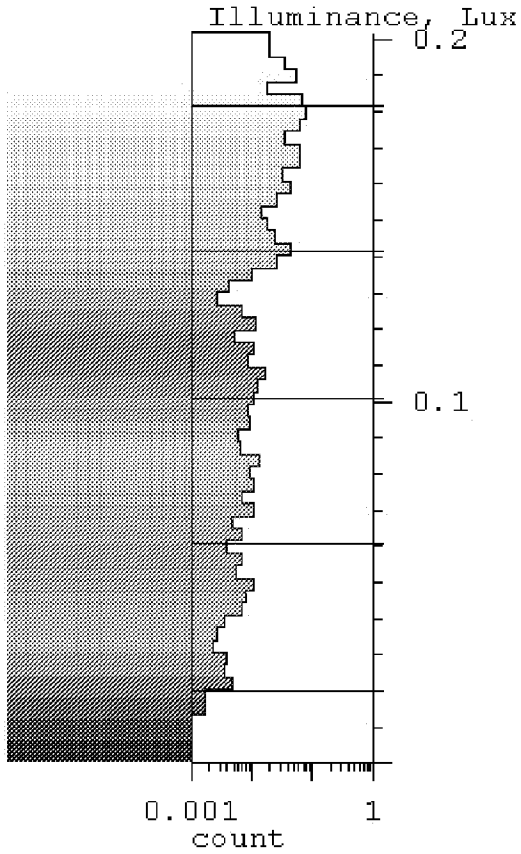
FIG. 16B is a histogram of the light intensity distribution of the distribution map in FIG. 16A.

FIG. 16A illustrates a color-coded distribution map of the light intensity for a large target surface 124 resulting from a side reflector system constructed in a manner that is similar to the system 100 of FIGS. 8-10. Because there is no incident light produced by the reflectors 80 (FIG. 10), there is no hot spot generated. Instead, the highest intensities of light are more uniformly distributed across the target surface 124. This is further demonstrated by a shift in the peak illuminance on the histogram of FIG. 16B as compared with FIG. 15D. More particularly, the target surface 124 (FIG. 16A) has a larger portion having an illuminance of greater than about 0.15 lux.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Furthermore, to the extent that the terms "includes", "having", "has", "with", "composed", "comprised" or variants thereof are used in either the detailed description or the claims, such terms are intended to be inclusive in a manner similar to the term "comprising."

While the present invention has been illustrated by a description of various embodiments and while these embodiments have been described in considerable detail, it is not the intention of the applicant to restrict or in any way limit the scope of the appended claims to such detail. Additional advantages and modifications will readily appear to those skilled in the art. Thus, the invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A light reflector for use with a light source, comprising:

a housing having a body with a plurality of facets, each of the plurality of facets having a shape that is a portion of one of a plurality of ellipses sharing a common focus, and first and second surfaces formed by first and second planes intersecting along a line within a volume of the body, wherein the housing is arranged relative to the light source so that the light source is positioned near the first surface and at the common focus, and the housing is angularly oriented relative to the light source such that a majority of light emitted by the light source is directed into the housing, reflected by at least one of the plurality of facets, and exits the light reflector out of either the first surface or the second surface.

2. The light reflector of claim 1, wherein each of the plurality of facets includes one or more small planar facet segments.

3. The light reflector of claim 1, wherein the body includes a free-form surface which is generated as the best fit to the plurality of facets.

4. The light reflector of claim 1, wherein the body is constructed from a polymeric material, a glass, or a metal.

5. The light reflector of claim 1 further comprising the light source, the light source selected from the group consisting of a light emitting diode, an organic light emitting diode, an arc lamp, an Ultra-High Pressure lamp, a laser diode, and a High-Intensity Discharge lamp.

6. The light reflector of claim 1, wherein the housing is hollow and has an inner surface coated with a reflective material, and the first and second surfaces are first and second edges of the hollow housing.

7. The light reflector of claim 1, wherein the housing is a solid filled structure.

8. The light reflector of claim 1, wherein the first and second surfaces of the housing intersect at an angle ranging from about 90° to about 150°.

9. The light reflector of claim 1, wherein the angular orientation of the light source relative to the first surface ranges from about 0° to about 45°.

10. A side reflector system comprising:

a plurality of the light reflectors according to claim 1, wherein the light reflectors are mounted at a distance from a target surface.

11. The side reflector system of claim 10, wherein the target surface is a parking lot, a street, or a sign.

12. The side reflector system of claim 10, further comprising:

a post supporting the light reflectors.

13. A flood lighting system for illuminating a target surface, the flood lighting system comprising:

a plurality of light sources; and a plurality of light reflectors, each of the plurality of light reflectors comprising a housing having a body with a plurality of facets, each of the plurality of facets having a shape that is a portion of one of a plurality of ellipses sharing a common focus, and first and second surfaces formed by first and second planes intersecting along a line within a volume of the body, wherein one of the plurality of light sources is positioned near the first surface, at the common focus, and is angularly oriented relative to the respective housing such that a majority of light emitted by the light source is directed into the respective housing, reflected by at least one of the plurality of facets, and exits the light reflector out of one of the first or second surfaces, wherein the flood lighting system is mounted at a distance from the target surface.

14. The flood lighting system of claim 13, wherein each of the housings includes a free-form surface which is generated as the best fit to the plurality of facets.

15. The flood lighting system of claim 13, wherein each of the housings is constructed from a polymeric material, a glass, or a metal.

16. The flood lighting system of claim 13, wherein each light source is a light emitting diode, an organic light emitting diode, an arc lamp, an Ultra-High Pressure lamp, a laser diode, or a High-Intensity Discharge lamp.

17. The flood lighting system of claim 13, wherein each housing is hollow and has an inner surface coated with a reflective material, and the first and second surfaces are first and second edges of the hollow housing.

18. The flood lighting system of claim 13, wherein each of the housings is a solid structure.

19. The flood lighting system of claim 13, wherein the first and second planes intersect at an angle ranging from about 90° to about 165°.

20. The flood lighting system of claim 13, wherein the angular orientation of the light source relative to the first plane ranges from about 0° to about 45°.

21. The flood lighting system of claim 13, wherein the plurality of light reflectors are arranged in a linear arrangement.

22. The flood lighting system of claim 13, wherein the plurality of light reflectors are arranged in a two-dimensional array.

23. The flood lighting system of claim 13, wherein each of the plurality of light reflectors is comprised of the same shape.

* * * * *